US005382027A

United States Patent [19]

Eatherly

[11] Patent Number: 5,382,027

[45] Date of Patent: Jan. 17, 1995

[54] SIMULATED DOUGH TOSSING GAME

[76] Inventor: Pauline Eatherly, 29252 Kensington Dr., Laguna Niguel, Calif. 92677-1600

[21] Appl. No.: 202,767

[22] Filed: Feb. 28, 1994

[51] Int. Cl.[6] ..... A63B 67/00

[52] U.S. Cl. ..... 273/317; 273/412; 273/424; 273/428; 273/DIG. 4

[58] Field of Search ..... 273/317, 318, 323, 326, 273/412, 424, 428, DIG. 4

[56] References Cited

U.S. PATENT DOCUMENTS 3,009,701 11/1961 Goldfarb ..... 273/326 X 3,811,682 5/1974 Neale et al. ..... 273/DIG. 4 X

*Primary Examiner*—William H. Grieb

*Attorney, Agent, or Firm*—Robert J. Schaap

[57] ABSTRACT

A simulated dough tossing and placement game of both skill and enjoyment. The game comprises a flexible material sheet simulating a sheet of dough and having a flexibility approximately equivalent to that of a sheet of dough used for the making of a pizza. A sheet-receiving member, such as a simulated pizza plate or pan, forms part of the game and is designed to receive the sheet of material when tossed in the same manner as the tossing of a sheet of pizza dough. The sheet-receiving member has a flat bottom wall to receive and catch the sheet of material when the latter is tossed with a twisting or rotating motion, much in the same manner as simulating the tossing the sheet of pizza dough onto a pizza pan. In this way, skill is involved in the play of the game and substantial enjoyment is also generated therefrom.

12 Claims, 1 Drawing Sheet

SIMULATED DOUGH TOSSING GAME

BACKGROUND OF THE INVENTION

1. Field of the Invention

This invention relates in general to certain new and useful improvements in a simulated dough tossing game and more particularly, to a game of the type stated in which a sheet of flexible and foldable material, simulating a piece of pizza dough, is tossed to a sheet-receiving member in a game of skill and enjoyment.

2. Brief Description of the Prior Art

It is quite common in the making of pizza for the cook or other person involved in the production of the pizza to form a sheet of dough, usually in a circular form and toss that sheet of dough to a pizza dough-receiving pan. The pan itself is oftentimes a flat plate, although it can adopt the form of a conventional pan with a flat bottom and a continuous side wall.

Usually the party tossing the sheet of dough attempts to twirl or rotate the sheet before flinging the same into an airborne pattern and attempts to cause the sheet of dough to land on the pizza pan. This type of activity is usually performed as a type of amusement for customers watching the production of the pizza.

There has always been a need for new games in the marketplace and many of these games involve food and the production of food. For example, there are puzzles for children in which the puzzle pieces are assembled to form a device appearing to be a pizza. There are also other games in which individual playing pieces in the shape of pizza slices are used in a game of chance.

There are also numerous games which involve the tossing or throwing of one object toward another, as for example, the throwing of a tennis ball toward a tennis racquet, the throwing of a dart toward a dart board and the like. However, and heretofore, there has not been any game which utilizes something simulating a sheet of pizza dough for tossing into or onto something simulating a pizza pan.

OBJECTS OF THE INVENTION

It is, therefore, one of the primary objects of the present invention to provide a simulated dough tossing game in which a user tosses a sheet of material simulating a piece of dough to a receiving object.

It is another object of the present invention to provide a simulated dough tossing game of the type stated in which a user attempts to toss a plastic sheet approximating the characteristics of a sheet of dough into a pan or on top of a plate.

It is a further object of the present invention to provide a simulated dough tossing game of the type stated which closely approximates the tossing of a pizza dough onto a pizza pan.

It is an additional object of the present invention to provide a simulated dough tossing game of the type stated which improves manual dexterity, as well as providing a source of enjoyment.

It is another object of the present invention to provide a method of playing a game which involves the tossing of a simulated sheet of dough onto a receiving object.

It is still a further object of the present invention to provide a simulated dough tossing game of the type stated which can be constructed at a relatively low cost, but which is highly effective in providing a high degree of play value and aids in training in manual dexterity and coordination.

With the above and other objects in view, my invention resides in the novel features of form, construction, arrangement and combination of parts presently described and pointed out in the claims.

BRIEF SUMMARY OF THE DISCLOSURE

The present invention relates in general to a simulated dough tossing and placement game of enjoyment and skill. The game is relatively simple in that it relies upon the use of a sheet of material simulating a sheet of dough, and a receiving object, such as a plate or a pan simulating a pizza pan.

The sheet of plastic which is used in the present invention basically simulates a sheet of dough and has a flexibility approximating that of a thin sheet of dough to be made into a pizza. Moreover, the sheet of dough will have a size approximating that of a sheet of pizza dough, namely approximately 12 to 18 inches in diameter.

The sheet receiving member has a sufficient size to receive and removably retain the material sheet. The sheet receiving member has a flat bottom wall in order to receive this material sheet. In accordance with this game, a player attempts to achieve a twisting or rotating motion of the material sheet and tossing same to attempt to cause the sheet to land in the sheet receiving member and on the flat bottom wall thereof, much in the same manner and simulating the tossing of a sheet of pizza dough onto a pizza pan. In this way, the player of the game participates in both a game of enjoyment and a game of skill.

In another embodiment of the invention, the sheet receiving member is in the shape of a pan. Further, and in another embodiment of the invention, the material sheet actually has an appearance to simulate a sheet of dough. In still another embodiment, the sheet receiving member is in the form of a relatively flat plate.

The material sheet has sufficient internal integrity to enable it to be twisted and tossed where it will adopt somewhat of a flat sheet form during a free flight of the material sheet. However, as indicated above, the material sheet, in a preferred embodiment, is actually a plastic sheet. Moreover, the preferred plastic material is light in weight.

This invention possesses many other objects and purposes which will be made more clearly apparent from a consideration of the forms in which it may be embodied. A few of the forms of the invention are illustrated in the accompanying drawings and are described in more detail in the accompanying detailed description. It should be understood that this detailed description and the accompanying drawings are set forth only for purposes of illustrating and describing the general principles of the invention, but are not to be taken in a limiting sense.

BRIEF DESCRIPTION OF THE DRAWINGS

Figures 1, 2, 3, 4:
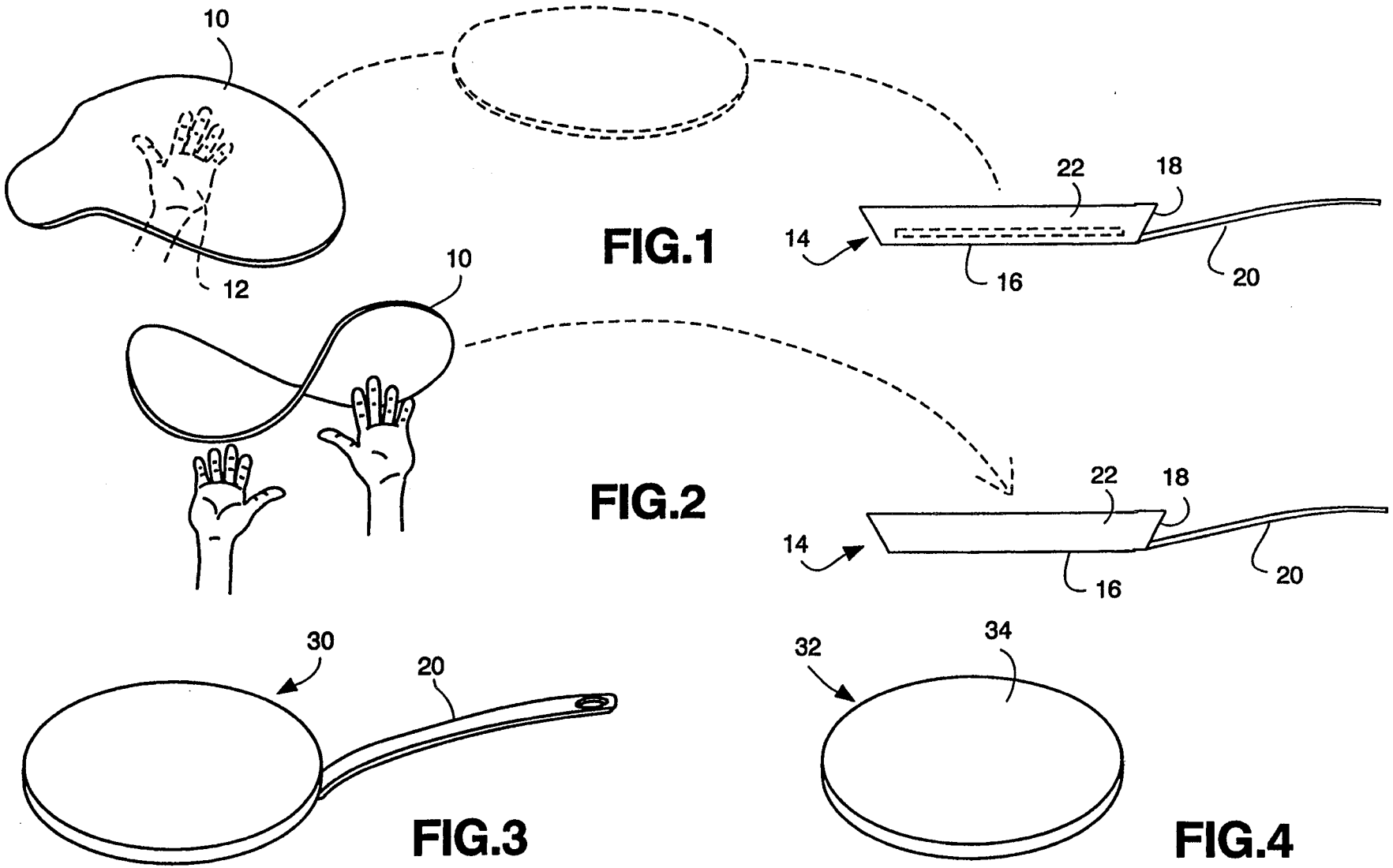

Having thus described the invention in general terms, reference will now be made to the accompanying drawings in which:

FIG. 1 is a schematic perspective view showing components forming part of and a mode of play of a simulated dough tossing game constructed in accordance with and embodying the present invention;

FIG. 2 is a schematic view showing a modified form of playing the simulated dough tossing game of the present invention;

FIG. 3 is a perspective view of a modified form of receiving member which may be used in the simulated dough tossing game of the present invention; and FIG. 4 is a perspective view of a further modified form of receiving member which may be used in the simulated dough tossing game of the present invention.

DETAILED DESCRIPTION OF PREFERRED EMBODIMENTS

Referring now in more detail and by reference characters to the drawings which illustrate practical embodiments in the play of the simulated dough tossing game of the preset invention, FIG. 1 illustrates a sheet of dough 10 held by a player's hand 12. In this case, the sheet of dough 10 may be in a form which somewhat approaches a flat disc-like element as, for example, by twirling the same.

In the case of the present invention, the simulated sheet of dough is not an actual sheet of dough, as such, but is preferably in the form of a sheet of plastic material having those characteristics which approximate the characteristics of a thin, flat sheet of dough.

Also provided for use with the game device of the present invention is a pan 14 having a relatively flat bottom wall 16 and an upstanding peripherally extending side wall 18, along with a handle 20. In this case, the pan includes an inner chamber 22 which is sized to receive the relatively flat simulated sheet of dough 10.

By further reference to FIG. 1, it can be seen that the user will take the relatively flat plastic sheet of simulated dough 10 and place the same over his or her finger tips, much in the manner as illustrated in FIG. 1. At that point, the sheet itself which is somewhat flexible and foldable will drape around the player's hand 12. However, as the player begins to rotate his or her hand, and hence, the simulated sheet of plastic dough 10, the sheet 10 will spread out in the form approximating a disc. At that point, the user can then toss the disc, as shown in FIG. 1. The user attempts to cause the simulated sheet of dough 10 to land in the inner chamber 22 of the pan 14 and on the upper surface of the bottom wall 16 thereof.

In a preferred mode of play, the user of the game device will drape the simulated sheet of dough 10 over the fingertips on one hand and hold a pan 14 by the handle 20 in his or her opposite hand. In this way, the user will toss the sheet of dough 10 and also simultaneously manipulate the position of the pan 14 so as to catch the sheet of dough 10. The dotted lines in FIG. 1 illustrate a path of movement of the simulated sheet of dough 10 from the hand 12 of the user to the pan 14.

In a more preferred embodiment of the invention, the simulated sheet of dough is formed of a low linear density polyethylene material. Preferably, this is a polyethylene extruded foam core material, or otherwise, a similar type of polyurethane extruded foam core material may be used. In each case, the materials, to more accurately simulate a sheet of pizza dough, would have a thickness of between about 0.125 inches and 0.310 inches in nominal thickness. The extruded foam core material has the characteristics of being light in weight and relatively smooth on its exterior surfaces. Furthermore, the exterior surface of the sheet of plastic is generally abrasion resistant.

The sheet-receiving member, such as the pan 14, or any of the other sheet-receiving members as hereinafter described, is also formed of a lightweight plastic such as polyethylene or polyurethane. In this case, the pan can be easily formed by injection molding the polyethylene or polyurethane.

FIG. 2 illustrates a slightly modified play of the game of the present invention. In this case, a user is using the flat palm of both hands to hold the simulated sheet of dough 10. However, and here again, the simulated sheet of dough 10 being flexible and foldable will initially drape over the hands of the user. When the user employs both hands to rotate the sheet of dough 10, he or she can then attempt to toss that simulated sheet of dough 10 in the pan 14, as shown. This mode of play is also highly effective with the game device of the present invention and can be played with this game device, as well as in the mode as shown in FIG. 1.

FIG. 3 illustrates a slightly modified form of pan 30 which may also be used with the game device of the present invention. In this case, the modified form of pan 30 does not have an upstanding peripherally extending side wall 18, such that the modified pan 30 assumes the form of a relatively flat plate having a handle 20 connected thereto.

It should be understood in connection with the present invention, that any mechanism for securing the handle 20 to the pan 14 or other flat plate may be provided. Furthermore, the sheet-receiving member may adopt a variety of forms, such as a flat plate, as shown, or a pan, as also shown. Nevertheless, the invention is not limited to these forms of sheet-receiving members.

FIG. 4 illustrates a further modified form of sheet-receiving member, also in the nature of a pan 32. In this case, the pan 32 is similar to the pan 14, except that the pan 32 does not utilize an elongate handle, such as the handle 20. In this embodiment of the invention, the user will merely hold the undersurface of the pan bottom wall 34 on his or her fingertips and attempt to maneuver the pan to catch the simulated sheet of dough 10.

It can be seen that the simulated dough tossing game is effective in providing a game which has features similar to that of one attempting to toss a sheet of pizza dough in the form of a disc into a pan. The twirling and tossing of a disc-like sheet of dough into a pan or onto a flat plate requires some degree of skill and practice and hence, the game device of the present invention would enable one to actually practice at the twirling and tossing of a simulated sheet of dough. The game can be played by use of scores in which competing players attempt to compete with one another by achieving the highest possible score in accurately tossing the simulated sheet of dough into a pan. In addition, the game is highly effective for use in play by a single individual.

Thus, there has been illustrated and described a unique and novel simulated dough-tossing game which provides an entirely new type of game and a method of play therefor. The present invention thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. A simulated dough tossing and placement game of enjoyment and skill, said game comprising:

a) a flexible foldable material sheet comprising a single sheet of material and simulating a sheet of dough and having a flexibility approximating that of a thin sheet of dough to be made into a pizza, said sheet being formed of a soft drapable material which will drape around the fingers and hands of a player when held on upright fingertips of a player, said sheet also having sufficient integrity so that when engaged by the fingertips of a player of the game on the underside thereof and twirled, it will assume somewhat of a flat shape for purposes of launching and propelling; and b) a sheet-receiving member having a sufficient size and shape to correspond to that sheet to receive and reasonably retain the material sheet, said sheet-receiving member having a flat bottom wall such that a player attempts to achieve a twisting or rotating of said material sheet and tosses same from the fingertips of that player to attempt to cause the sheet to land in the sheet-receiving member and on the flat bottom wall thereof, said sheet being launched from the fingertips of a hand of a player of the game initially in somewhat of a vertical trajectory when the hand and forearm of the player are in somewhat of a vertical orientation so that the sheet is launched and twirled around and partially hovers in a generally stable horizontal attitude, such that the tossing of the sheet simulates the tossing of a sheet of pizza dough into a pizza pan, whereby the player of the game tossing the sheet of material learns or improves the skill of tossing including hand-eye coordination and improving manual dexterity and which game provides a source of play enjoyment.

2. The simulated dough tossing and placement game of claim 1 further characterized in that the sheet-receiving member is in the shape of a pan.

3. The simulated dough tossing and placement game of claim 1, further characterized in that said sheet of material drapes downward from the fingertips of a player when in a static condition, and when twirled about the fingertips with sufficient rotational force, the sheet will assume the shape of a flat plate.

4. The simulated dough tossing and placement game of claim 1 further characterized in that said sheet has the appearance of a sheet of dough.

5. The simulated dough tossing and placement game of claim 1 further characterized in that said material sheet has sufficient integrity to enable it to be twisted and tossed where it will assume somewhat of a flat sheet form during a free flight of the material sheet.

6. The simulated dough tossing and placement game of claim 1 further characterized in that said sheet is a plastic sheet.

7. The simulated dough tossing and placement game of claim 1 further characterized in that said plastic sheet is formed of an extruded foam core polyethylene.

8. The simulated dough tossing and placement game of claim 1 further characterized in that said sheet-receiving member is in the shape of a relatively flat plate with no handle thereon.

9. A method of playing a game of enjoyment and skill involving the tossing of a flexible drapable sheet of material from a player's hand or fingertips into a sheet-receiving member, said method comprising:

a) draping a sheet of the soft drapable material on the fingertips of a player when the player's forearm and hand are in a generally vertical orientation so that the sheet drapes about the fingers and hand of the player when held in this position on the fingertips of the player;

b) imparting a twirling motion to the forearm and hand of the player by the player causing the material sheet to assume somewhat of a flat shape for purposes of launching and propelling the same, said sheet having sufficient integrity so that when engaged by the fingertips of a player of the game on the underside thereof and twirled it will assume somewhat of a flat shape for purposes of launching and propelling; and c) launching said sheet from the fingertips or a hand of a player of the game initially in somewhat of a vertical trajectory when the hand and forearm of the player are in somewhat of a vertical orientation and toward a sheet-receiving member so that the sheet is launched and twirled around and partially hovers in a generally stable horizontal attitude, said sheet-receiving member having a flat bottom wall such that a player attempts to achieve a twisting or rotating of said material sheet and tosses same attempting to cause the sheet to land in the sheet-receiving member and on the flat bottom wall thereof and with the sheet-receiving member having a size and shape sufficient to receive and retain the material sheet, said player launching the sheet attempting to cause the same to land in said sheet-receiving member, much in the manner of simulating the tossing of a sheet of pizza dough into a pizza pan, whereby the player of the game tossing the sheet of material learns or improves the skill of tossing, including hand-eye coordination and improving manual dexterity, and which game provides a source of play enjoyment.

10. The method of playing a game of claim 9 further characterized in that the player of the game manipulates the position of the sheet-receiving member with its other hand to catch the material sheet in the member.

11. The method of playing a game of claim 10 further characterized in that said sheet-receiving member is in the shape of a relatively flat plate and the player manipulates the position of the plate from the underside thereof.

12. The method of playing a game of claim 10 further characterized in that said sheet has the appearance of a sheet of dough.

* * * * *